US008506026B2

(12) United States Patent
Kim et al.

(10) Patent No.: US 8,506,026 B2
(45) Date of Patent: Aug. 13, 2013

(54) REFRIGERATOR WITH STEP ADJUSTMENT DEVICE

(75) Inventors: Ki Youn Kim, Buk-gu (KR); Man Soon Im, Gwangsan-gu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 498 days.

(21) Appl. No.: 12/457,594

(22) Filed: Jun. 16, 2009

(65) Prior Publication Data

US 2010/0033067 A1 Feb. 11, 2010

(30) Foreign Application Priority Data

Aug. 11, 2008 (KR) ..... 10-2008-0078272

(51) Int. Cl.
*A47B 96/04* (2006.01)

(52) U.S. Cl.
USPC ..... 312/405

(58) Field of Classification Search
USPC ..... 16/221, 236, 237, 240, 245, 382; 49/397, 399, 388, 381; 312/401, 405, 116, 312/326, 329, 348.4, 402
See application file for complete search history.

(56) References Cited

U.S. PATENT DOCUMENTS

| | | | | | |
|---|---|---|---|---|---|
| 532,044 | A | * | 1/1895 | Fagan | 16/245 |
| 994,196 | A | * | 6/1911 | Reddick | 16/245 |
| 2,050,891 | A | * | 8/1936 | Maisch | 16/340 |
| 2,441,221 | A | * | 5/1948 | Eckel | 16/245 |
| 2,523,821 | A | * | 9/1950 | Fox | 312/334.4 |
| 2,725,589 | A | * | 12/1955 | Papesh | 16/236 |
| 2,762,473 | A | * | 9/1956 | Swerdlow | 49/395 |
| 2,835,755 | A | * | 5/1958 | Filko | 200/19.27 |
| 2,839,778 | A | * | 6/1958 | Hutchinson et al. | 16/245 |
| 2,988,414 | A | * | 6/1961 | Crowe et al. | 312/326 |
| 3,063,318 | A | * | 11/1962 | Schlappal | 82/159 |
| 3,290,109 | A | * | 12/1966 | Vanegas | 312/326 |
| 3,389,424 | A | * | 6/1968 | Fellwock | 16/392 |
| 3,555,733 | A | * | 1/1971 | Horgan | 49/388 |
| 3,618,993 | A | * | 11/1971 | Platte | 52/713 |
| 3,675,271 | A | * | 7/1972 | Fellwock et al. | 16/265 |
| 3,890,670 | A | * | 6/1975 | Sewing et al. | 16/236 |
| 4,070,728 | A | * | 1/1978 | Herman | 16/243 |
| 4,141,109 | A | * | 2/1979 | Farrell | 16/237 |
| 4,185,357 | A | * | 1/1980 | Busse | 16/265 |
| 4,189,805 | A | * | 2/1980 | Backus | 16/237 |
| 4,286,352 | A | * | 9/1981 | Pittasch | 16/237 |
| 4,406,087 | A | * | 9/1983 | Asaka et al. | 49/70 |
| 4,690,571 | A | * | 9/1987 | Fulterer | 384/22 |
| 4,720,896 | A | * | 1/1988 | Lautenschlager et al. | 16/382 |
| 4,932,729 | A | * | 6/1990 | Thompson et al. | 312/405 |
| 5,040,857 | A | * | 8/1991 | Mandel et al. | 312/405 |
| 5,265,954 | A | * | 11/1993 | Keil | 312/405 |
| 5,272,789 | A | * | 12/1993 | Mitchell et al. | 16/291 |

(Continued)

FOREIGN PATENT DOCUMENTS

KR 10-2008-0047151 5/2008

*Primary Examiner* — Janet M Wilkens
*Assistant Examiner* — Timothy M Ayres
(74) *Attorney, Agent, or Firm* — Staas & Halsey LLP

(57) ABSTRACT

Disclosed is a refrigerator capable of adjusting a step difference of a refrigerator door. The refrigerator includes a body, a door opening/closing the body, a hinge member having a hinge shaft to be coupled with the door, a mounting member fixed to the body to receive the hinge member, and an adjusting unit coupled with the hinge member to adjust a step difference of the door by moving the hinge member.

8 Claims, 9 Drawing Sheets

(56) References Cited

U.S. PATENT DOCUMENTS

| | | | | |
|---|---|---|---|---|
| 5,483,770 | A * | 1/1996 | Marinoni | 49/388 |
| 5,500,983 | A * | 3/1996 | Lautenschlager | 16/304 |
| 5,579,606 | A * | 12/1996 | Kim | 49/386 |
| 5,666,764 | A * | 9/1997 | Beatty et al. | 49/397 |
| 5,694,665 | A * | 12/1997 | Strickland et al. | 16/238 |
| 5,788,351 | A * | 8/1998 | Prunty et al. | 312/326 |
| 5,870,801 | A * | 2/1999 | Kim | 16/382 |
| 5,884,366 | A * | 3/1999 | Jeong | 16/271 |
| 5,960,518 | A * | 10/1999 | Jeong | 16/270 |
| 5,975,663 | A * | 11/1999 | Becker | 312/405 |
| 6,070,300 | A * | 6/2000 | Shin et al. | 16/382 |
| 6,085,385 | A * | 7/2000 | Joo | 16/268 |
| 6,128,807 | A * | 10/2000 | Lim et al. | 16/266 |
| 6,141,830 | A * | 11/2000 | Shimooka | 16/237 |
| 6,233,783 | B1 * | 5/2001 | Dubach | 16/237 |
| 6,286,185 | B1 * | 9/2001 | Ramsauer | 16/236 |
| 6,375,291 | B1 * | 4/2002 | Nam et al. | 312/405 |
| 6,901,633 | B2 * | 6/2005 | Chen | 16/240 |
| 7,065,832 | B2 * | 6/2006 | Pohl | 16/235 |
| 7,137,677 | B2 * | 11/2006 | Hong et al. | 312/401 |
| 7,213,300 | B1 * | 5/2007 | Domenig et al. | 16/236 |
| 7,231,691 | B1 * | 6/2007 | Domenig et al. | 16/236 |
| 7,350,272 | B2 * | 4/2008 | Fries | 16/246 |
| 7,516,517 | B2 * | 4/2009 | Fries | 16/246 |
| 7,552,511 | B2 * | 6/2009 | Campbell et al. | 16/238 |
| 7,694,389 | B2 * | 4/2010 | Erickson et al. | 16/243 |
| 7,735,943 | B2 * | 6/2010 | Hottmann | 312/401 |
| 7,748,080 | B2 * | 7/2010 | Hottmann | 16/72 |
| 2004/0123424 | A1 * | 7/2004 | Chiu | 16/221 |
| 2004/0237257 | A1 * | 12/2004 | Pohl | 16/221 |
| 2005/0262663 | A1 * | 12/2005 | Lee | 16/221 |
| 2007/0289093 | A1 * | 12/2007 | Nallamottu | 16/236 |
| 2008/0018212 | A1 * | 1/2008 | Spearing et al. | 312/236 |
| 2008/0022491 | A1 * | 1/2008 | Campbell et al. | 16/236 |
| 2008/0168618 | A1 * | 7/2008 | Hottmann | 16/50 |
| 2009/0025178 | A1 * | 1/2009 | Tamayama et al. | 16/221 |
| 2009/0289536 | A1 * | 11/2009 | Park et al. | 312/405 |

* cited by examiner

REFRIGERATOR WITH STEP ADJUSTMENT DEVICE

CROSS-REFERENCE TO RELATED APPLICATIONS

This application claims the benefit of Korean Patent Application No. 10-2008-0078272, filed on Aug. 11, 2008, in the Korean Intellectual Property Office, the disclosure of which is incorporated herein by reference.

BACKGROUND

1. Field

The present invention relates to a refrigerator. More particularly, the present invention relates to a refrigerator capable of adjusting a step difference of a refrigerator door.

2. Description of the Related Art

In general, a refrigerator is a device to store foods under a low temperature. The refrigerator freezes or refrigerates the foods according to the state of the foods. To this end, cold air supplied into the refrigerator is generated through heat exchange of a refrigerant. In other words, the cold air is continuously supplied into the refrigerator through a cycle of compression-condensation-expansion-evaporation, and uniformly spread in the refrigerator through convection, so that the foods can be stored in the refrigerator under a desired temperature.

Meanwhile, such a refrigerator includes a body having an internal space partitioned into a refrigerating compartment and a freezing compartment, and a door selectively opening/closing the internal space. In addition, upper and lower ends of the door are hinged to the body by upper and lower hinge units so that a front surface of the body is open/closed by the door. Hinge grooves are formed at the upper and lower ends of the door, respectively, and the upper and lower hinge units are installed in the hinge grooves.

However, in the upper and lower hinge units provided in the door, a hinge plate provided at one end thereof with a hinge shaft is screwed into a top surface of the body, so that the hinge shaft integrated with the hinge plate cannot move if the hinge plate is fixed to the body of the refrigerating chamber. Accordingly, it is difficult to adjust a gap formed between the door and the body.

SUMMARY

Accordingly, it is an aspect of the present embodiments to provide a refrigerator capable of adjusting a step difference of a refrigerator door.

Additional aspects and/or advantages will be set forth in part in the description which follows and, in part, will be apparent from the description, or may be learned by practice of the invention.

The foregoing and/or other aspects are achieved by providing a refrigerator, including a body to store foodstuffs to be cooled, a door opening/closing the body, a hinge member having a hinge shaft configured to be coupled with the door, a mounting member fixed to the body receiving the hinge member, and an adjusting unit coupled with the hinge member adjusting a step difference of the door by moving the hinge member.

The adjusting unit may include a first adjusting screw configured to move the hinge member in a first direction.

The mounting member may include a first fixing section bent upward from one edge of the mounting member, and the hinge member includes a first bending section formed corresponding to a portion of the first fixing section.

The first bending section may include a first coupling section coupled with the first adjusting screw. The first adjusting screw may include a screw head section, a fixed washer section spaced apart from the screw head section, and a space section formed between the screw head section and the fixed washer section to be coupled with the first coupling section.

The first adjusting screw may couple the first bending section with the first fixing section, and, when the first adjusting screw is rotated, the hinge member may move in a first direction so that the door moves in the first direction by the hinge member.

The adjusting unit may include a second adjusting screw configured to move the hinge member in a second direction.

The mounting member may include a second fixing section bent upward from a rear edge of the mounting member, and the hinge member may include a second bending section corresponding to the second fixing section.

A washer member may be interposed between the second fixing section and the second bending section so that the second adjusting screw is rotatable at an original position thereof. The second adjusting screw may include a washer fitting slot coupled with the washer member.

The second adjusting screw may couple the second bending section with the second fixing section, and, when the second adjusting screw is rotated, the hinge member rotates in the second direction so that the door rotates in the second direction by the hinge member.

The second bending section may include a second coupling section such that the second coupling section is coupled with a thread section of the second adjusting screw.

A fixing member may be coupled with the mounting member such that the fixing member closely fixes the hinge member onto the body.

The fixing member may include a coupling shaft rotatably coupled with the mounting member, a pressing section pressing and fixing the hinge member according to a rotation of the coupling shaft, and a grip section extending from the pressing section in a longitudinal direction and configured to rotate in order to cause the pressing section to fix the hinge member to the mounting member.

The adjusting unit may include a rotating member rotatable about a rotation axis to adjust the step difference of the door.

The hinge member may include an extension section extending in one direction, and the rotating member includes a rotating grip section having a fixing support section eccentrically spaced apart from the rotation axis so as to be coupled with the extension section.

A support member may be fixed to the body to support the extension section while surrounding the extension section.

The hinge member may include a protrusion section having a form of a rack gear, and the rotating member may include a gear member having a shape corresponding to the protrusion section and causing movement of the hinge member when the gear member is rotated in relation to the protrusion section.

The foregoing and/or other aspects are achieved by providing a refrigerator includes a body to store foodstuffs to be cooled, a door opening/closing the body, a mounting member fixed to the body, a hinge member coupled with the door and the mounting member, a fixing member rotatably coupled with the mounting member such that the hinge member is fixed to the body, and an adjusting unit adjusting a step difference of the door by moving the hinge member.

The adjusting unit may include a first adjusting screw movable back and forth in a first direction to move the hinge member in the first direction and a second adjusting screw rotatable at an original position thereof to move the hinge member in a second direction.

The hinge member may include an extension section extending in the first direction, and the adjusting unit may include a rotating plate section rotating about a rotating axis, and a fixed support section formed on the rotating plate section and configured to be coupled with the extension section in a state in which the fixed support section is eccentrically spaced apart from the rotation axis.

The hinge member may include a protrusion section having a form of a rack gear, and the adjusting unit may include a gear member having a shape corresponding to the protrusion section and causing movement of the hinge member when the gear member is rotated in relation to the protrusion section.

A fixing member may be further provided to closely fix the hinge member to the body or the mounting member.

The foregoing and/or other aspects are achieved by providing a refrigerator, including: a body to store foodstuffs to be cooled; a door opening/closing the body; a hinge member fixed to the body and coupling the door and the body, the hinge member configured to be moved in at least a first direction.

The refrigerator may further include an adjusting unit, a rotation of the adjusting unit causing the hinge member to move in the first direction and/or a second direction.

The adjusting unit may include a first adjusting screw, the rotation of which causes the hinge member to move in the first direction, and a second adjusting screw, the rotation of which causes the hinge member to move in the second direction.

The refrigerator may further include a rotatable member coupled with the hinge member, the rotatable member rotatable about a rotation axis to cause the hinge member to be moved in the first direction.

The foregoing and/or other aspects are achieved by providing a hinge unit for a door of a refrigerator having a body, including: a hinge member fixed to the body and coupling the door and the body, the hinge member configured to be moved in a first direction and/or a second direction; and an adjusting unit, at least one rotation of the adjusting unit causing the hinge member to move in the at least first direction.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF EMBODIMENTS

Figure 1:
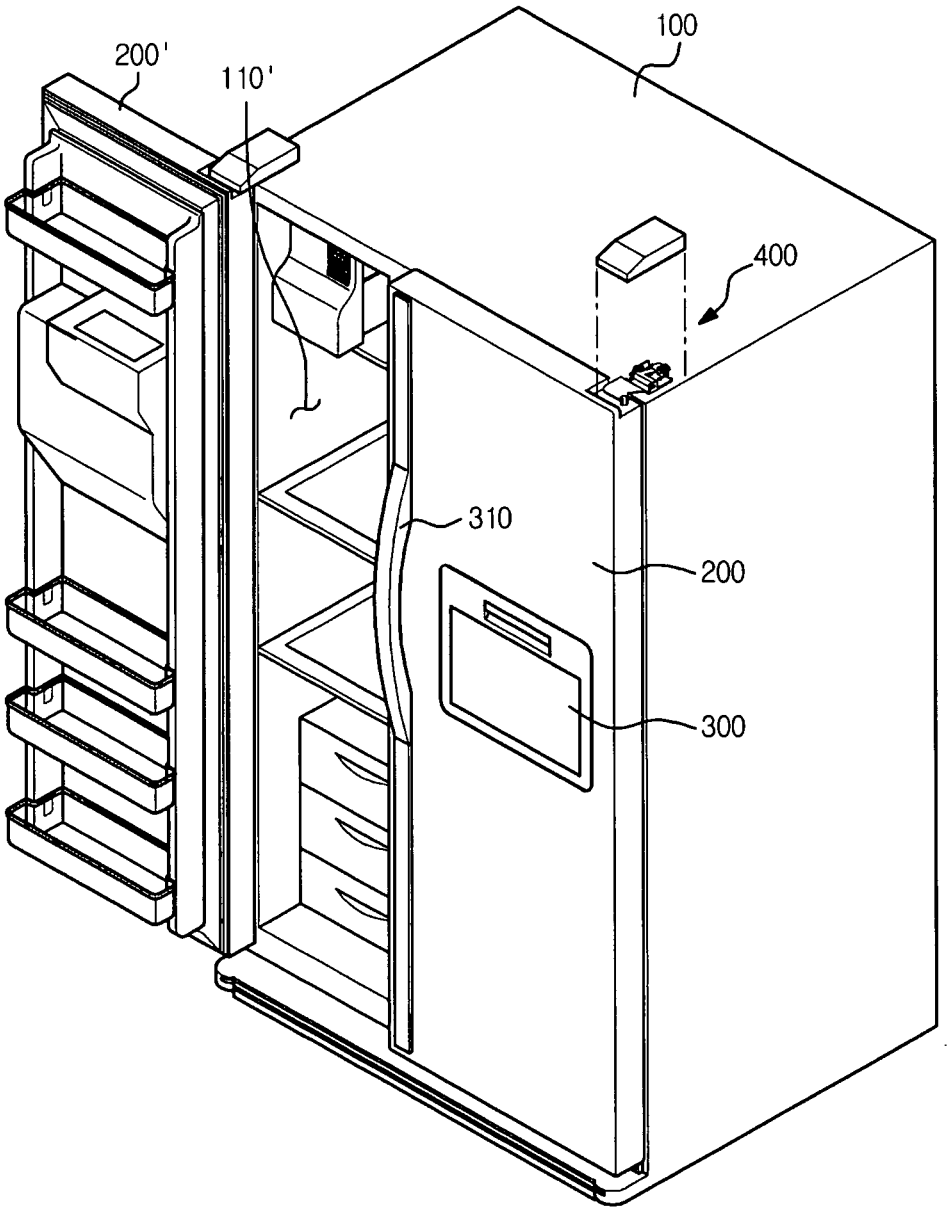
FIG. 1 is a perspective view showing a refrigerator according to one embodiment.

Reference will now be made in detail to the embodiments, examples of which are illustrated in the accompanying drawings, wherein like reference numerals refer to the like elements throughout. The embodiments are described below to explain the present invention by referring to the figures.

Hereinafter, an embodiment will be described in detail with reference to accompanying drawings.

FIG. 1 is a perspective view showing a refrigerator according to one embodiment.

As shown in FIG. 1, the refrigerator according to one embodiment includes a refrigerator body 100 forming an outer appearance of the refrigerator, a freezing compartment 110' to freeze foods and a refrigerating compartment (not shown) to refrigerate the foods, which are formed in the refrigerator body 100 by partitioning the inside of the refrigerator body 100. In general, in the two-door type refrigerator, the freezing compartment 110' and the refrigerating compartment are provided at left and right sides of the refrigerator body 100, respectively.

Doors 200' and 200 are provided at front surfaces of the freezing compartment 110' and the refrigerating compartment (not shown). The doors 200' and 200 rotate to selectively open/close the freezing compartment 110' and the refrigerating compartment. Hereinafter, the door 200' will be referred to as a freezing compartment door, and the door 200 will be referred to as a refrigerating compartment door. The freezing compartment door 200' is installed corresponding to a front surface of the freezing compartment 110' such that the freezing compartment door 200' can be opened leftward, and the refrigerating compartment door 200 is installed corresponding to a front surface of the refrigerating compartment such that the refrigerating compartment door 200 can be opened rightward. However, the embodiment is not limited thereto, so long as the refrigerating compartment door 200 and the freezing compartment door 200' are opened in opposing directions with respect to one another.

Door grips 310 may be provided at a right portion of the front surface of the freezing compartment door 200' and a left portion of the front surface of the refrigerating compartment door 200, respectively, such that a user can open the freezing compartment and refrigerating compartment doors 200' and 200 by using the door grips 310.

A home bar 300 may further be provided on the refrigerating compartment door 200. The home bar 300 allows a user to easily take out foods stored in the refrigerating compartment or put the foods into the refrigerating compartment without opening the refrigerating compartment door 200. The home bar 300 has a predetermined size sufficient to minimize leakage of cold air from the inside the refrigerating compartment.

The refrigerating compartment door 200 is opened/closed relative to the front surface of the refrigerator body 100 by at least one hinge unit 400 provided at upper and lower ends of the refrigerating compartment door 200.

Figure 2:
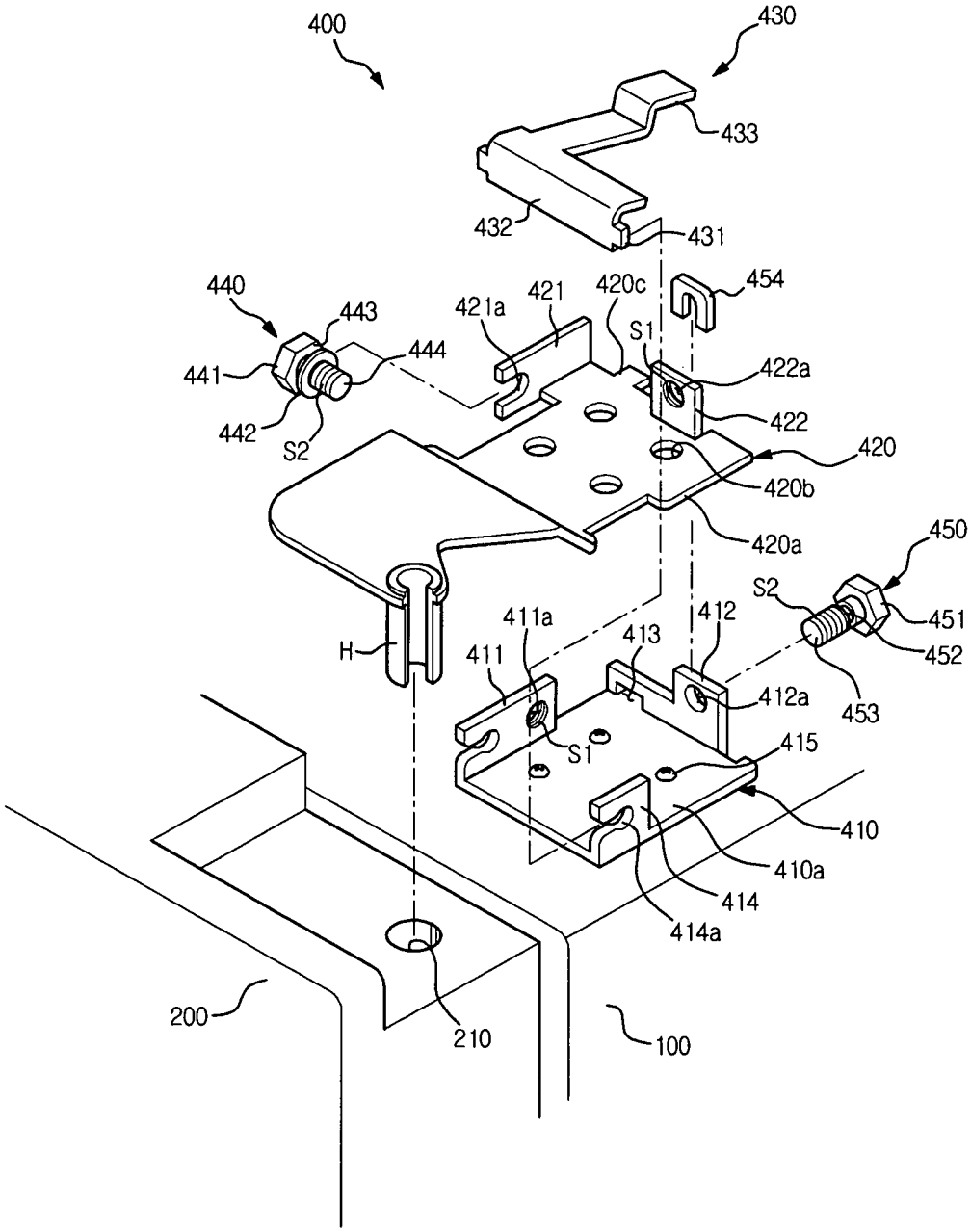
FIG. 2 is an exploded perspective view of a hinge unit according to one embodiment.
Figure 3:
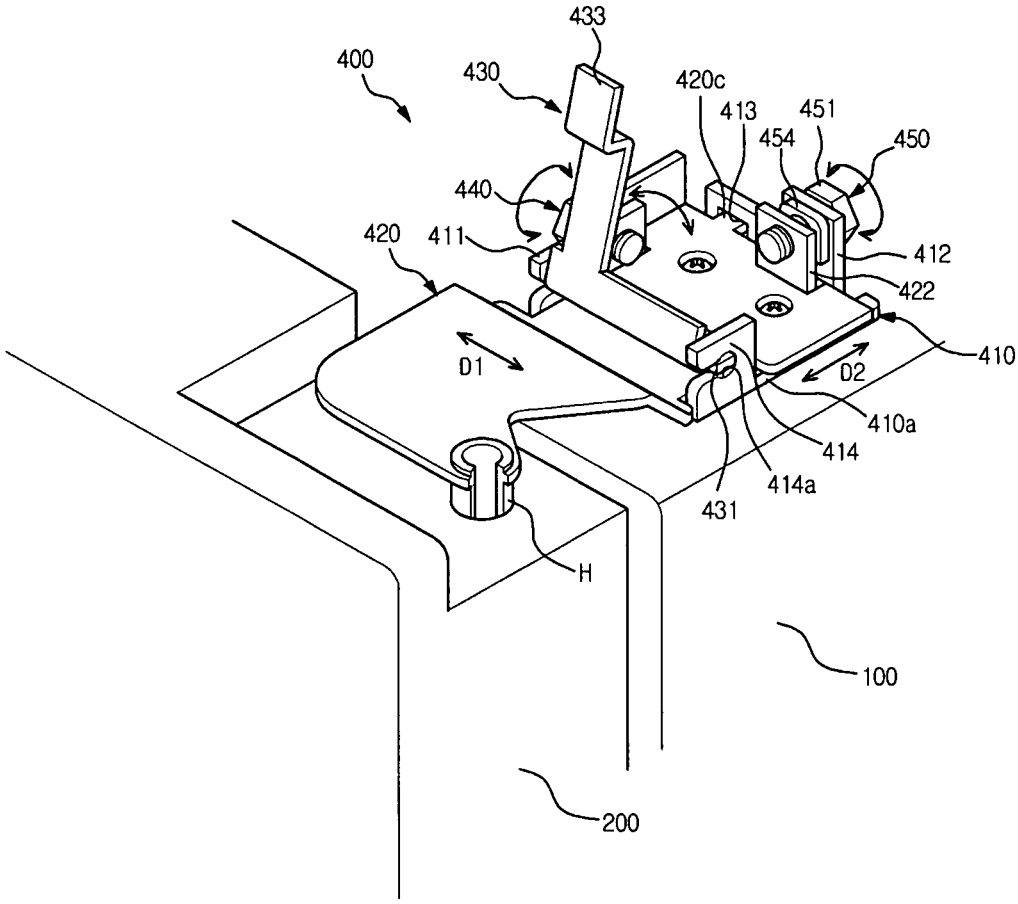
FIG. 3 is an assembled perspective view of a hinge unit according to one embodiment.

FIG. 2 is an exploded perspective view of the hinge unit 400 according to one embodiment, and FIG. 3 is an assembled perspective view of the hinge unit 400 shown in FIG. 2.

As shown in FIGS. 2 and 3, the hinge unit 400 according to one embodiment includes a mounting member 410, a hinge member 420, first and second adjusting units 440 and 450, and a fixing member 430. The mounting member 410 is fixed to the refrigerator body 100. The hinge member 420 is coupled to the refrigerating compartment door 200 and the mounting member 410. The first and second adjusting units 440 and 450 adjust the step difference of the refrigerating compartment door 200 by moving the hinge member 420. The fixing member 430 closely fixes the hinge member 420 to the refrigerator body 100 by pressing the hinge member 420. Although it is shown in FIG. 2 that the hinge unit 400 according to an embodiment is mounted on the upper end of the refrigerating compartment door 200, the hinge unit 400 may be mounted on the lower end of the refrigerating compartment door 200.

The mounting member 410 is fixed to a top surface of the refrigerator body 100 such that the hinge member 420 can move in a first direction D1 and/or a second direction D2. Such a mounting member 410 includes a plate section 410*a* having a plurality of coupling holes (not shown) such that screws 415 are coupled into the refrigerator body 100 by passing through the coupling holes, however any other type of fixing mechanism may be used to fix the plate section 410*a* to the refrigerator body 100. A first fixing section 411 is bent upward from one edge of the plate section 410*a*. The first fixing section 411 includes a first through hole 411*a* formed at the inside thereof with a female thread S1. A second fixing section 412 is bent upward from a rear edge of the plate section 410*a*. Similarly to the fixing section 411, the second fixing section 412 includes a second through hole 412*a*. The second fixing section 412 includes an insertion hole 413 formed by cutting a portion of the second fixing section 412 lengthwise along the second fixing section 412.

A plurality of screw coupling holes (not shown) are formed on the top surface of the body 100 corresponding to the coupling holes of the mounting member 410 such that the mounting member 410 is fixed on the body 100 by using a screw 415, for example, but is not limited thereto. Accordingly, the mounting member 410 allows the hinge member 420 to maintain the coupling state with the refrigerator body 100 such that the refrigerating compartment door 200 can rotate in one direction. Meanwhile, side plates 414 having a predetermined height are provided on opposing ends of the plate section 410*a*. The side plates 414 may be integrated with the plate section 410*a*, and may be provided with coupling grooves 414*a* into which the fixing member 430, which will be described later, can be inserted.

The hinge member 420 is provided on the mounting member 410 to couple the upper end of the refrigerating compartment door 200 with the refrigerator body 100. The hinge member 420 includes a base section 420*a* overlapped with the mounting member 410 while closely making contact with the mounting member 410. The base section 420*a* has a plate shape and is integrally formed at one side thereof with a hinge shaft H so that the base section 420*a* may be coupled to the refrigerating compartment door 200.

The hinge member 420 is provided at one side thereof with a first bending section 421 that is bent upward from a position corresponding to that of the first fixing section 411 of the mounting member 410. The first bending section 421 extends upward such that the first bending section 421 is bent at about 90 degrees with respect to the base section 420*a*. The bending section 421 is provided at one end thereof with a first coupling section 421*a* recessed by a predetermined depth.

In addition, the hinge member 420 is provided at a rear end thereof with a second bending section 422 bent upward at a position corresponding to that of the second fixing section 412 of the mounting member 410. Similarly to the first bending section 421, the second bending section 422 extends upward such that the second bending section 422 is bent at about 90 degrees with respect to the base section 420*a*. In addition, the second bending section 422 includes a second coupling section 422*a* formed at the inside thereof with the female thread S1.

Meanwhile, the hinge member 420 is provided with an insertion protrusion 420*c* at a position corresponding to that of the insertion hole 413 of the second fixing section 412 of the mounting member 410. As the insertion protrusion 420*c* of the hinge member 420 is inserted into the insertion hole 413, the hinge member 420 can be more stably coupled to the mounting member 410. In addition, the base section 420*a* is provided at a central portion thereof with a screw guide hole 420*b* such that a screw 415 is able to pass through the screw guide hole 420*b* to fix and/or disassemble the mounting member 410 to and/or from the refrigerator body 100.

The hinge unit 400 includes the adjusting units 440 and 450 to adjust a fine step difference of the refrigerating compartment door 200. The adjusting units 440 and 450 are a first adjusting screw 440 to adjust the movement of the refrigerating compartment door 200 in the first direction D1 and a second adjusting screw 450 to adjust the movement of the refrigerating compartment door 200 in the second direction D2. Although it is shown in the drawings that the first direction D1 represents a left or right direction on the basis of the front surface of the refrigerator, and the second direction D2 represents a front or rear direction on the basis of the front surface of the refrigerator, the first direction D1 and/or the second direction D2 may represent various directions according to the installation position of the hinge unit 400 and the first and second adjusting screws 440 and 450.

The first adjusting screw 440 couples the first fixing section 411 of the mounting member 410 with the first bending section 421 of the hinge member 420 corresponding to the first fixing section 411.

The first adjusting screw 440 is provided at the outer portion thereof with a first screw head section 441, and a fixed washer section 442 is formed spaced apart from the first screw head section 441. A space section 443 is formed between the first screw head section 441 and the fixed washer section 442 such that the first screw head section 441 is spaced apart from the fixed washer section 442 by a predetermined distance. In this case, the first screw head section 441 has various shapes adaptable for various tools, and the space section 443 is engaged with the first coupling section 421*a* of the first bending section 421. The size of the space section 443 may be adjusted depending on the thickness of the first coupling section 421*a*.

A first thread section 444 is formed on an outer circumferential surface of a cylinder that extends from the first screw head section 441 while passing through the fixed washer section 442. The first thread section 444 includes a male thread S2 such that the first thread section 444 can move in the first direction D1 along the female thread S1 formed on an inner circumferential surface of the first through hole 411*a* of the first fixing section 411.

The second adjusting screw 450 couples the second fixing section 412 formed at the rear end of the mounting member 410 with the second bending section 422 formed at the rear end of the hinge member 420 corresponding to the second fixing section 412. In addition, a washer member 454 is interposed between the second fixing section 412 and the second bending section 422 to allow the second adjusting screw 450 to rotate at an original position thereof.

The second adjusting screw 450 is provided at an outer portion thereof with a second screw head section 451, and a washer fitting slot 452 is formed while being spaced apart from the second screw head section 451 to be coupled with the washer member 454. A second thread section 453 is formed on an outer circumferential surface of a cylinder that extends from the second screw head section 451. The second thread section 453 includes the male thread S2 such that the male thread S2 rotates at an original position thereof along the female thread S1 formed at the second coupling section 422*a* without reciprocation. Therefore, the second bending section 422 of the hinge member 420 can move in the second direction D2 according to the rotation of the second adjusting screw 450.

The fixing member 430 is provided on the hinge member 420 to press the hinge member 420 so that the hinge member 420 is fixed to the refrigerator body 100. The fixing member 430 includes a coupling shaft 431 rotatably coupled with the mounting member 410. The coupling shaft 431 is rotatably inserted into the coupling grooves 414*a* formed at both ends of the mounting member 410. The fixing member 430 includes a pressing section 432 and a grip section 433. The pressing section 432 presses the hinge member 420 to closely fix the hinge member 420 to the refrigerator body 100 when the coupling shaft 431 rotates. The grip section 433 extends from the pressing section 432 in a longitudinal direction. Accordingly, if the grip section 433 is rotated at a predetermined angle in a state in which the coupling shaft 431 is coupled with the mounting member 410, the pressing section 432 presses the base section 420*a* of the hinge member 420 against the plate section 410*a* of the mounting member 410 and the top surface of the refrigerator body 100. It can be understood to those skilled in the art that the fixing member 430 according to the present embodiments may have various shapes so long as the base section 420*a* of the hinge member 420 can closely make contact with the mounting member 410 without forming a gap therebetween.

Figure 4:
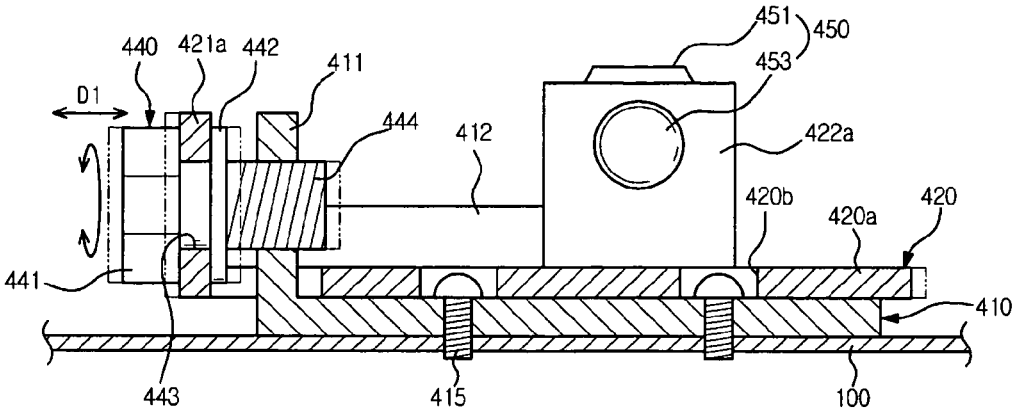
FIG. 4 is a view showing the operation of a first adjusting screw according to one embodiment.

Hereinafter, the operation of the hinge unit 400 of the refrigerator having the above structure according to one embodiment will be described. FIG. 4 is a view showing the procedure in which the hinge member 420 moves in the first direction D1 through the first adjusting screw 440.

As shown in FIG. 4, when the first adjusting screw 440 is rotated clockwise or counterclockwise, the first adjusting screw 440 moves through the first fixing section 411 fixed to the refrigerator body 100. At this time, the first coupling section 421*a* coupled with the space section 443 of the first adjusting screw 440 moves in the first direction D1 according to the movement of the first adjusting screw 440. Therefore, the hinge member 420 integrated with the first coupling section 421*a* moves in the first direction D1. Accordingly, the step difference of the refrigerating compartment door 200 and the distance between the refrigerator body 100 and the refrigerating compartment door 200 can be adjusted by moving the hinge member 420 in the refrigerator.

Figure 5:
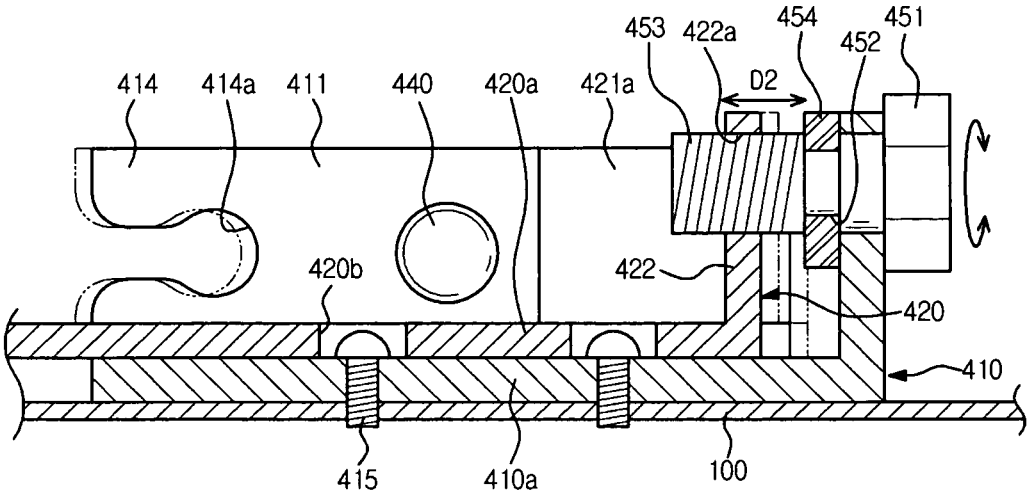
FIG. 5 is a view showing the operation of a second adjusting screw according to one embodiment.

FIG. 5 is a view showing the procedure in which the hinge member 420 moves through the second adjusting screw 450.

As shown in FIG. 5, when a user rotates the second adjusting screw 450 clockwise or counterclockwise, the second adjusting screw 450 rotates at an original position thereof in the second fixing member 412 fixed to the refrigerator body 100. In other words, when the second screw head section 451 rotates in a state in which the washer member 454 is assembled with the washer fitting slot 452 of the second adjusting screw 450, the second adjusting screw 450 rotates at an original position thereof without moving back and forth. At this time, the hinge member 420 moves in the second direction D2 due to the engagement between the female thread S1 of the second coupling section 422*a* and the male thread S2 of the second adjusting screw 450. Therefore, the hinge member 420 integrated with the second coupling section 422*a* moves in the second direction D2. Accordingly, the step difference of the refrigerating compartment door 200 and the distance between the refrigerator body 100 and the refrigerating compartment door 200 can be adjusted by moving back and forth the hinge member 420 in the refrigerator.

In other words, the first adjusting screw 400 and/or the second adjusting screw 450 are capable of being rotated, thereby able to finely adjust the distance of the refrigerating compartment door 200 and the refrigerator body 100. Accordingly, the step difference of the refrigerating compartment door 200 of the two-door type refrigerator can be adjusted in a right, left, front, or rear direction.

Figure 6:
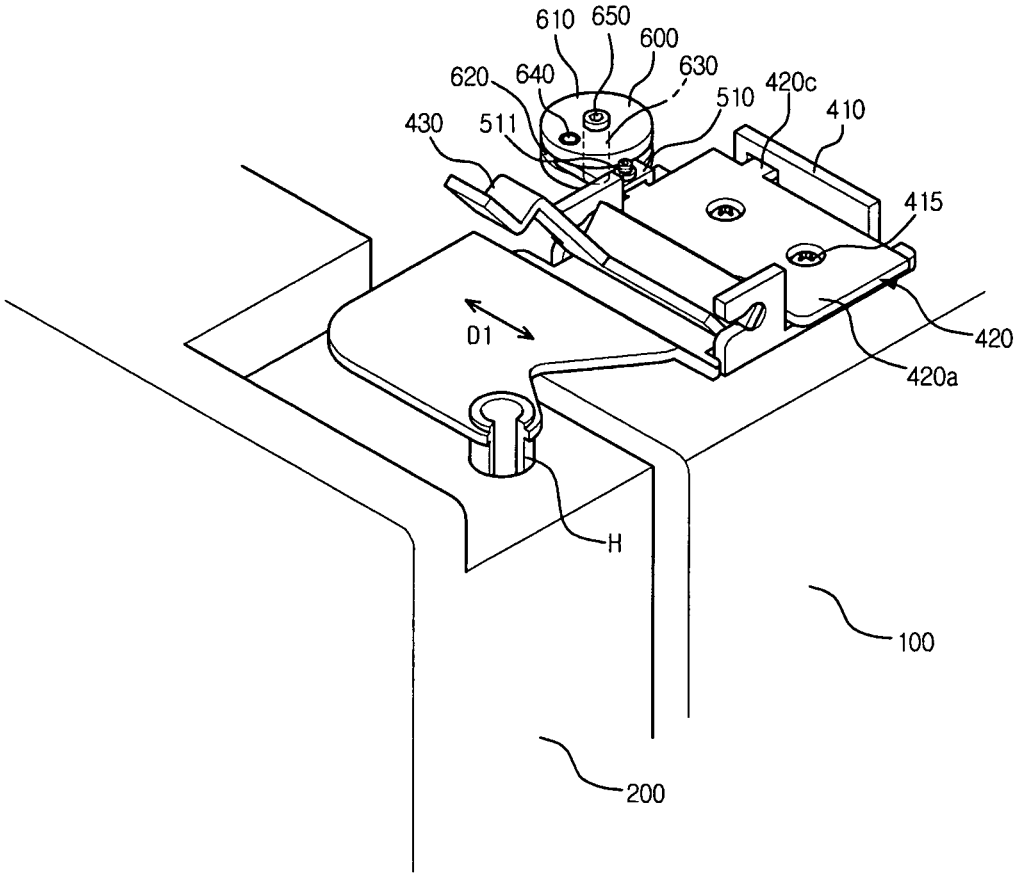
FIG. 6 is a perspective view showing a hinge unit according to another embodiment.
Figure 7:
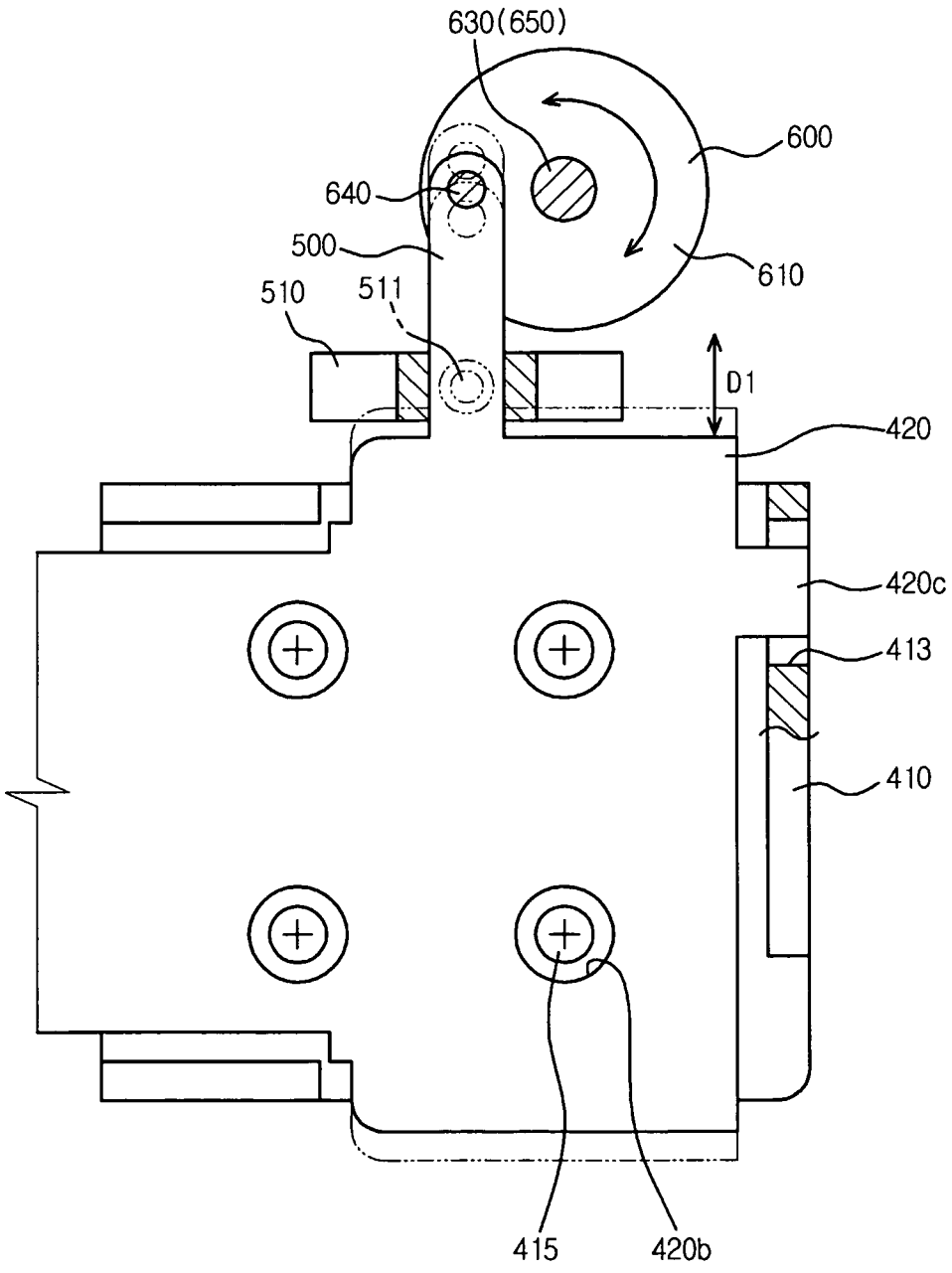
FIG. 7 is a view showing the operation of a hinge unit according to another embodiment.

FIG. 6 is a perspective view showing a hinge unit according to another embodiment of the present invention, and FIG. 7 is a sectional view showing the procedure in which a hinge member shown in FIG. 6 moves.

As shown in FIG. 6, similarly to the hinge unit 400 according to one embodiment, the hinge unit according to another embodiment includes the mounting member 410, the hinge member 420, an adjusting unit 600, and the fixing member 430. Meanwhile, the same reference numbers will be assigned to elements identical to those of the previous embodiment, and details thereof will be omitted.

The mounting member 410 is fixed to the top surface of the refrigerator body 100 such that the hinge member 420 moves in the first direction D1. The hinge member 420 includes the base section 420*a* and an extension section 500. The base section 420*a* is overlapped with the mounting member 410 while closely making contact with the mounting member 410. The extension section 500 extends from the base section 420*a* by a predetermined length in one direction.

The hinge member 420 is provided at one side thereof with the adjusting unit which is a rotating grip member 600 fixedly coupled with the extension section 500. The rotating grip member 600 includes a rotating plate section 610 rotating about a rotating shaft 630. The rotating plate section 610 is provided with a guide slot section 620 recessed by a predetermined depth along a rim of the rotating plate section 610. The rotating plate section 610 is provided with a fixing support section 640 eccentrically spaced apart from the rotating shaft 630 so as to be coupled with the extension section 500.

A support member 510 is provided between the hinge member 420 and the rotating plate section 610 to support the extension section 500 while surrounding the extension section 500. The support member 510 is provided with a bolt coupling section 511 restraining or releasing the hinge member 420. The fixing member 430 is provided on the hinge member 420 to press the hinge member 420 downward such that the hinge member 420 is closely fixed to the mounting member 410.

As shown in FIG. 7, when a user rotates the rotating grip member 600 clockwise or counterclockwise by using a first tool hole 650, the extension section 500 of the hinge member 420 coupled with the rotating grip member 600 moves in the first direction D1 with the rotating grip member 600. In other words, the distance between the refrigerator body 100 and the refrigerating compartment door 200 coupled with the hinge member 420 can be finely adjusted by rotating the rotating grip member 600 as described above. Accordingly, the step difference of the refrigerating compartment door 200 of the two-door type refrigerator can be adjusted in the first direction D1.

Figure 8:
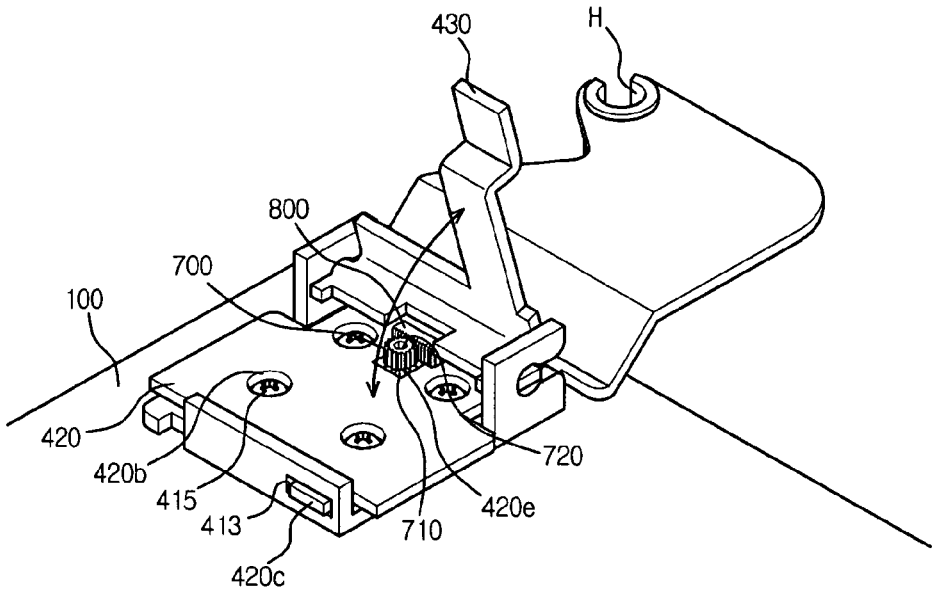
FIG. 8 is a perspective view showing a hinge unit according to still another embodiment.
Figure 9:
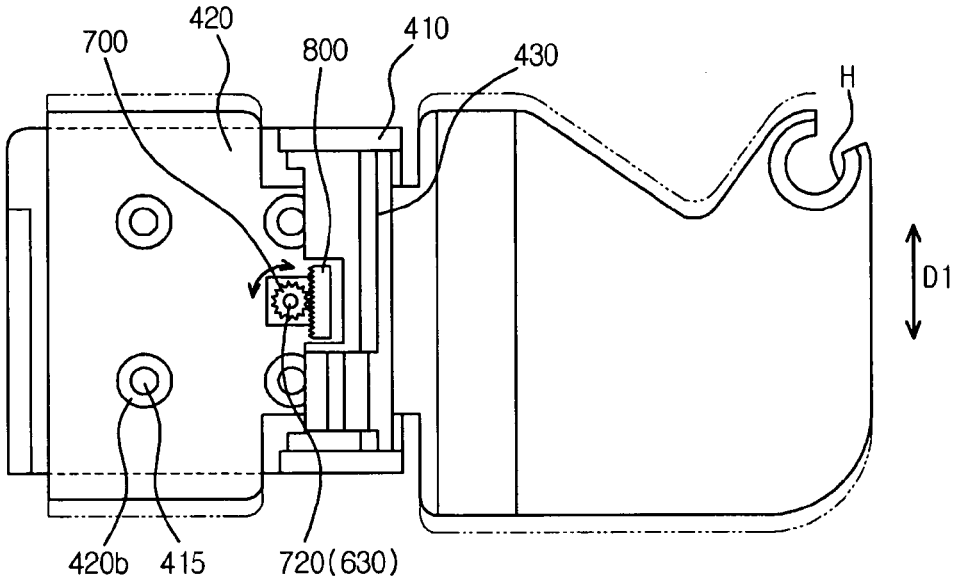
FIG. 9 is a view showing the operation of a hinge unit according to still another embodiment.

FIG. 8 is a perspective view showing a hinge unit according to still another embodiment, and FIG. 9 is a sectional view showing the operational state of a hinge unit shown in FIG. 8.

As shown in FIG. 8, similarly to one embodiment, the hinge unit according to still another embodiment includes the mounting member 410, the hinge member 420, an adjusting unit 700, and the fixing member 430 in order to adjust a micro-step difference of a refrigerator door. Meanwhile, the same reference numbers will be assigned to elements identical to those of the previous embodiment, and details thereof will be omitted.

The mounting member 410 is fixed onto the top surface of the refrigerator body 100 to receive the hinge member 420 such that the hinge member 420 can move in the first direction D1. The hinge member 420 is provided at one portion thereof with a protrusion section 800 having a plurality of protrusions uniformly formed in the form of a rack gear.

The adjusting unit (700) includes a gear member 700 having teeth 710 engaged with the protrusion section 800 of the hinge member 420 to adjust the movement of the refrigerating compartment door 200 in the first direction D1. The gear member 700 is rotatably mounted on the mounting member 410 through a gear through hole 420*e* provided in the hinge member 420. The gear member 700 is engaged with the protrusion section 800 of the hinge member 420 to rotate about a rotation axis provided at a central portion thereof. The fixing member 430 is provided on the hinge member 420 to press the hinge member 420 downward such that the hinge member 420 is closely fixed to the mounting member 410.

As shown in FIG. 9, if a user rotates the gear member 700 about the rotation axis clockwise or counterclockwise by using a second tool hole 720, the protrusion section 800 of the hinge member 420 engaged with the gear member 700 moves in the first direction D1 with the gear member 700. In other words, the distance between the refrigerator body 100 and the refrigerating compartment door 200 coupled with the hinge member 420 can be finely adjusted by rotating the gear member 700 as described above. Accordingly, the step difference of the refrigerating compartment door 200 of the two-door type refrigerator can be adjusted in the first direction D1.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator, comprising:

a body to store foodstuffs to be cooled;

a door opening/closing the body;

a hinge member having a hinge shaft configured to be coupled with the door;

a mounting member fixed to the body receiving the hinge member, the mounting member including a first fixing section bent upward from one edge of the mounting member and a second fixing section bent upward from a rear edge of the mounting member, and the hinge member including a first bending section formed corresponding to a portion of the first fixing section, the first bending section including a first coupling section, and a second bending section corresponding to the second fixing section; and an adjusting unit coupled with the hinge member adjusting a step difference of the door by moving the hinge member, the adjusting unit including a first adjusting screw configured to move the hinge member in a first direction, the first adjusting screw including a screw head section, a fixed washer section spaced apart from the screw head section, a space section formed between the screw head section and the fixed washer section to be coupled with the first coupling section, and a thread section extending from the fixed washer section to an end of the first adjusting screw opposite the screw head section, the adjusting unit further including a second adjusting screw configured to move the hinge member in a second direction, wherein the refrigerator further comprises a washer member interposed between the second fixing section and the second bending section so that the second adjusting screw is rotatable at an original position thereof, the second adjusting screw including a washer fitting slot coupled with the washer member, and wherein the first coupling section is formed as a slot in the first bending section.

2. The refrigerator of claim 1, wherein the first adjusting screw couples the first bending section with the first fixing section, and, when the first adjusting screw is rotated, the hinge member moves in a first direction so that the door moves in the first direction by the hinge member.

3. The refrigerator of claim 1, wherein the second adjusting screw couples the second bending section with the second fixing section, and, when the second adjusting screw is rotated, the hinge member rotates in the second direction so that the door rotates in the second direction by the hinge member.

4. The refrigerator of claim 1, wherein the second bending section includes a second coupling section such that the second coupling section is coupled with a thread section of the second adjusting screw.

5. The refrigerator of claim 1, further comprising a fixing member coupled with the mounting member, the fixing member closely fixing the hinge member onto the body.

6. The refrigerator of claim 5, wherein the fixing member includes a coupling shaft rotatably coupled with the mounting member, a pressing section pressing and fixing the hinge member according to a rotation of the coupling shaft, and a grip section extending from the pressing section in a longitudinal direction and configured to rotate in order to cause the pressing section to fix the hinge member to the mounting member.

7. A refrigerator, comprising:

a body to store foodstuffs to be cooled;

a door opening/closing the body;

a mounting member fixed to the body, the mounting member including a first fixing section bent upward from one edge of the mounting member and a second fixing section bent upward from a rear edge of the mounting member;

a hinge member coupled with the door and the mounting member, the hinge member including a first bending section formed corresponding to a portion of the first fixing section, the first bending section including a first coupling section, and a second bending section corresponding to the second fixing section;

a fixing member rotatably coupled with the mounting member such that the hinge member is fixed to the body; and an adjusting unit adjusting a step difference of the door by moving the hinge member, the adjusting unit including a first adjusting screw configured to move the hinge member in a first direction, the first adjusting screw including a screw head section, a fixed washer section spaced apart from the screw head section, a space section formed between the screw head section and the fixed washer section to be coupled with the first coupling section, and a thread section extending from the fixed washer section to an end of the first adjusting screw opposite the screw head section, the adjusting unit further including a second adjusting screw configured to move the hinge member in a second direction, wherein the refrigerator further comprises a washer member interposed between the second fixing section and the second bending section so that the second adjusting screw is rotatable at an original position thereof, the second adjusting screw including a washer fitting slot coupled with the washer member, and wherein the first coupling section is formed as a slot in the first bending section.

8. A refrigerator, comprising:

a body to store foodstuffs to be cooled;

a door opening/closing the body;

a mounting member fixed to the body, the mounting member including a first fixing section bent upward from one edge of the mounting member and a second fixing section bent upward from a rear edge of the mounting member;

a hinge member fixed to the body and coupling the door and the body, the hinge member configured to be moved in at least a first direction, and the hinge member including a first bending section formed corresponding to a portion of the first fixing section, the first bending section including a first coupling section, and a second bending section corresponding to the second fixing section; and an adjusting unit adjusting a step difference of the door by moving the hinge member, the adjusting unit including a first adjusting screw configured to move the hinge member in a first direction, the first adjusting screw including a screw head section, a fixed washer section spaced apart from the screw head section, a space section formed between the screw head section and the fixed washer section to be coupled with the first coupling section, and a thread section extending from the fixed washer section to an end of the first adjusting screw opposite the screw head section, the adjusting unit further including a second adjusting screw, the rotation of which causes the hinge member to move in the second direction, wherein the refrigerator further comprises a washer member interposed between the second fixing section and the second bending section so that the second adjusting screw is rotatable at an original position thereof, the second adjusting screw including a washer fitting slot coupled with the washer member, and wherein the first coupling section is formed as a slot in the first bending section.

* * * * *